US006710532B2

(12) United States Patent
Choi

(10) Patent No.: US 6,710,532 B2
(45) Date of Patent: Mar. 23, 2004

(54) ELECTRON GUN IN COLOR CRT

(75) Inventor: Jin Yeol Choi, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/024,697

(22) Filed: Dec. 21, 2001

(65) Prior Publication Data

US 2002/0079819 A1 Jun. 27, 2002

(30) Foreign Application Priority Data

Dec. 23, 2000 (KR) ..... 2000-81170

(51) Int. Cl.[7] ..... H01J 29/50

(52) U.S. Cl. ..... 313/414; 313/412; 313/409; 313/448; 313/449; 313/439; 313/432

(58) Field of Search ..... 313/409, 414, 313/448, 449, 439, 432, 412

(56) References Cited

U.S. PATENT DOCUMENTS 4,877,998 A * 10/1989 Maninger et al. ..... 315/15
5,066,887 A * 11/1991 New ..... 313/414
5,430,349 A * 7/1995 New et al. ..... 313/412
6,222,310 B1 * 4/2001 Mera et al. ..... 313/409
6,255,767 B1 * 7/2001 Lee et al. ..... 313/414

* cited by examiner

*Primary Examiner*—Nimeshkumar D. Patel
*Assistant Examiner*—Holly Harper
(74) *Attorney, Agent, or Firm*—Fleshner & Kim, LLP

(57) ABSTRACT

An electron gun is provided for a CRT. The electrode gun includes three cathodes for emitting electron beams, a plurality of acceleration electrodes, and a focus electrode and an anode. The focus electrode and the anode each include an opposite rim having a single electron beam pass-through hole with a vertical width V and a horizontal width H, and an electrostatic field control body positioned at a distance D from the rim, with a bridge width 't', and a vertical width v and a horizontal width h of a central electron beam pass-through hole, wherein the electrostatic field control body and the focus electrode and the anode are configured to satisfy the following equation:

$$(V \times v \times D)/29 \geqq H-(2 \times S),$$

where, S denotes a sum of the horizontal width h and the bridge width t of the electrostatic field control body. Spherical aberration is prevented or reduced, improving a vertical resolution of the picture.

5 Claims, 7 Drawing Sheets

ELECTRON GUN IN COLOR CRT

BACKGROUND OF THE INVENTION

1. Field of the Invention

The invention relates to an electron gun in cathode ray tube. More particularly, the invention relates to a focus electrode and an anode in an electron gun of a cathode ray tube (CRT).

2. Background of the Related Art

FIG. 1 illustrates a schematic side view section of a CRT. The CRT of FIG. 1 includes a panel 1 and a funnel 2 forming a front and rear of the CRT. An electron gun 3 is provided in a neck part 2*a* at one end of the funnel 2 for emitting electron beams 3*a*. A deflection yoke 4 is disposed around an outer surface of the funnel 2 for deflecting the electron beams 3*a*. A shadow mask 5 is positioned between the electron gun 3 and the panel 1 for passing the deflected electron beams 3*a* therethrough. A fluorescent surface 7 coated on an inside surface of the panel 1.

FIG. 2 illustrates a side view of the electron gun 3 built into the neck part 2*a* of the color CRT. Referring to FIG. 2, the electron gun 3 includes cathodes 8, a control electrode 9, acceleration electrode 10, first and second pre-focus electrode 11*a* and 11*b*, a focus electrode 12, and an anode 13, each having a preset voltage applied thereto. The control electrode 9 and the acceleration electrode 10 are planar. The pre-focus electrodes 11*a* and 11*b*, the focus electrode 12, and the anode 13 are non-circular cylindrical. Each have electron beam pass-through holes for passing electron beams 3*a* therethrough.

When the foregoing CRT is put into operation, the electron beams 3*a* are emitted from the cathodes 8, and accelerated toward the anode 13 by a potential difference. Since preset voltages are applied to respective electrodes, the electron beams are controlled, accelerated, and pre-focused, respectively, by the control electrode 9, the acceleration electrode 10, the pre-focus electrode 11*a* and 11*b*. The main focusing of the electron beams is performed by a main focus electrostatic lens formed by a potential difference between the focus electrode 12 and the anode 13. The electron beams 3*a* are, then, deflected in the up, down, left, and or right direction by the deflection yoke 4, selectively passed through the shadow mask 5, and land on the fluorescent surface 7 to form a picture on the panel 1.

In the case of electron guns in recent large-sized color CRTs where a heavy current is essential, the heavy current makes the electron beam flux thicker, and leads it to pass through a protaxis of the main focus electrostatic lens. The electron beam passing through the protaxis has more spherical aberration than one passing through a paraxis. The spherical aberration causes blooming, a phenomena in which a spot size of the electron beam is formed greater at a central part of the screen. It is known that a horizontal spot size caused by blooming can be reduced by a VM (velocity Modulation) coil fitted to an outer circumference of the neck. However, since there has been no proper device external to the CRT for reducing a spot enlarged in a vertical direction due to spherical aberration, vertical blooming still remains on the screen, and deteriorates a vertical focus characteristic of the screen.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Accordingly, the invention is directed to an electron gun in a CRT that substantially obviates one or more of the problems due to limitations and disadvantages of the related art.

An object of the invention is to provide an electron gun in a CRT, in which a vertical diameter dv of a main focus electrostatic lens is configured to be greater in proportion to increased thickness of the electron beam flux where heavy current is used for the electron gun, preventing occurrence of spherical aberration, and improving a vertical resolution of a picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, an electron gun in a CRT includes three cathodes for emitting electron beams, a plurality of acceleration electrodes, and a focus electrode and an anode, each including an opposite rim having a single electron beam pass-through hole with a vertical width V and a horizontal width H, and an electrostatic field control body at a distance D from the rim, with a bridge width 't', and a vertical width v and a horizontal width h of a central electron beam pass-through hole, wherein the electrostatic field control body and the focus electrode and the anode can be related by the following equation (1):

$$(VxvxD)/29 \geqq H-(2\times S), \quad (1)$$

where, S denotes a sum of the horizontal width h and the bridge width t of the electrostatic field control body.

To further achieve these and other advantages and in accordance with the purpose of the invention, as embodied and broadly described, an electron gun in a CRT includes at least one cathode for emitting electron beams, at least one acceleration electrode, and a focus electrode and an anode each including an opposite rim having an electron beam pass-through hole with a vertical width V and a horizontal width H, and an electrostatic field control body positioned at a distance D from the rim, with a bridge width 't', and a vertical width v and a horizontal width h of a central electron beam pass-through hole, wherein the electrostatic field control body and the focus electrode and the anode are configured to satisfy the following equation (1):

$$(VxvxD)/29 \geqq H-(2\times S), \quad (1)$$

where, S denotes a sum of the horizontal width h and the bridge width t of the electrostatic field control body.

To further achieve these and other advantages and in accordance with the purpose of the invention, as embodied and broadly described, a method of optimizing the performance of an electrostatic field control body of an electron gun for a CRT includes (1) determining parameters influencing a vertical width dv of the electrostatic field control body, (2) determining parameters influencing a horizontal width dh of the electrostatic field control body; and (3) optimizing the electrostatic field control body based on the parameters determined in steps (1) and (2).

It is to be understood that both the foregoing general description and the following detailed description are exemplary and explanatory and are intended to provide further explanation of the invention as claimed.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

The accompanying drawings, which are included to provide a further understanding of the invention and are incorporated in and constitute a part of this specification, illustrate embodiments of the invention and together with the description serve to explain the principles of the invention:

In the drawings:

FIG. 1 is a schematic side view section of a CRT;

FIG. 2 is a schematic side view of an electron gun built into a neck part of the CRT of FIG. 1;

FIG. 3 is a schematic side view section of the focus electrode and anode of the electron gun in FIG. 2, taken along line II—II in FIG. 2;

FIG. 4 is a schematic front view of the focus electrode or the anode of FIG. 2, taken along line I—I or II—II, showing an electrostatic field control body fitted therein;

Figure 6:
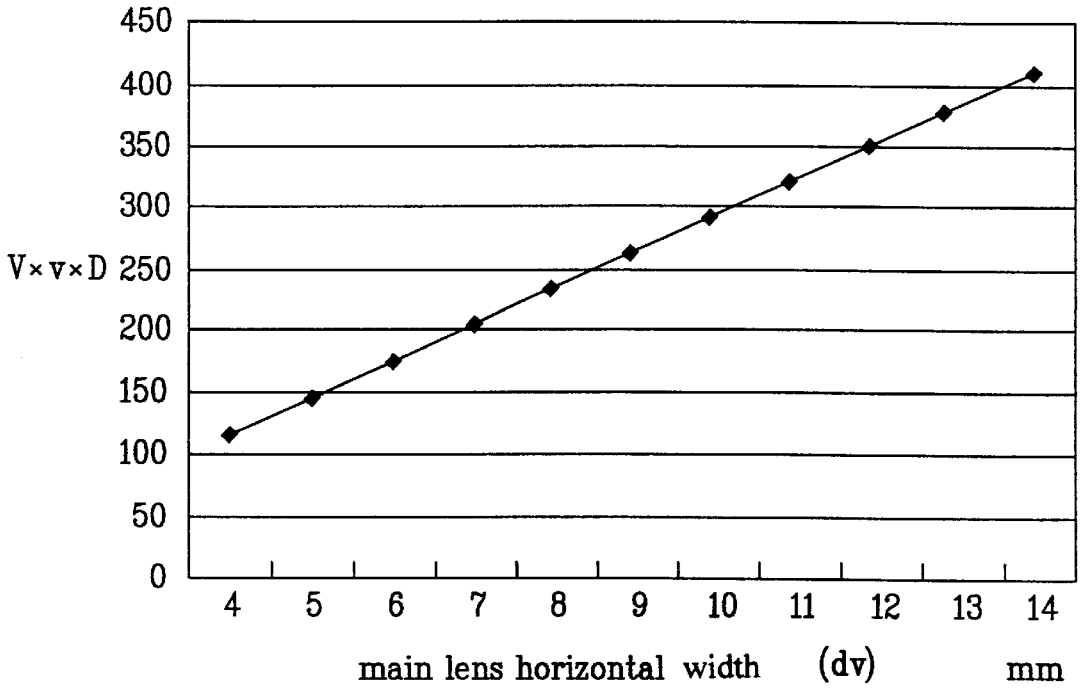
Figure 7:
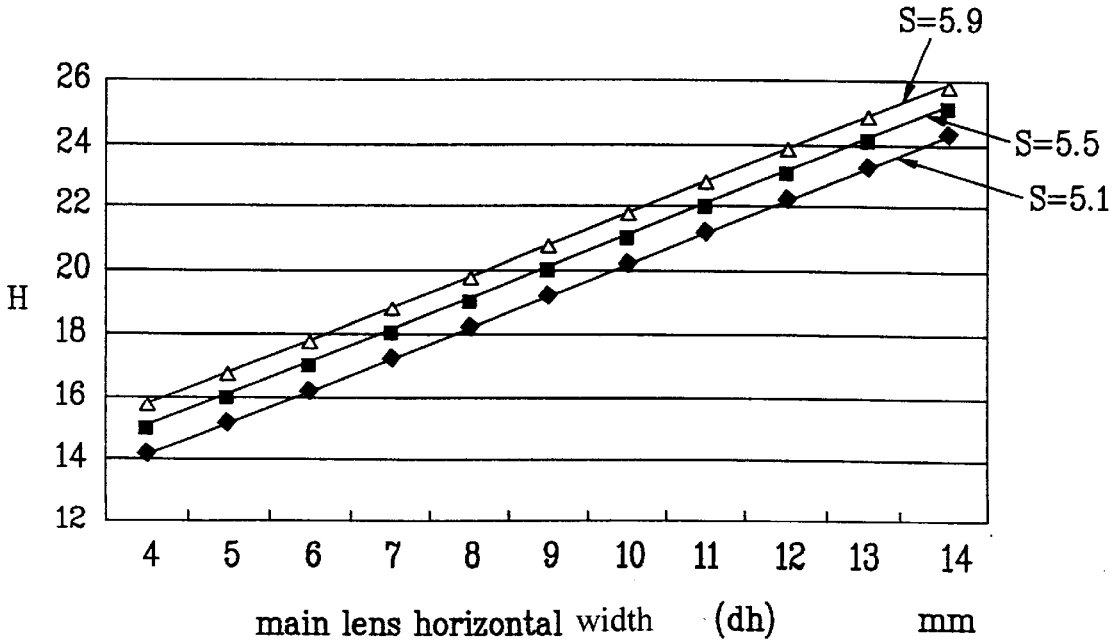
Figure 8:
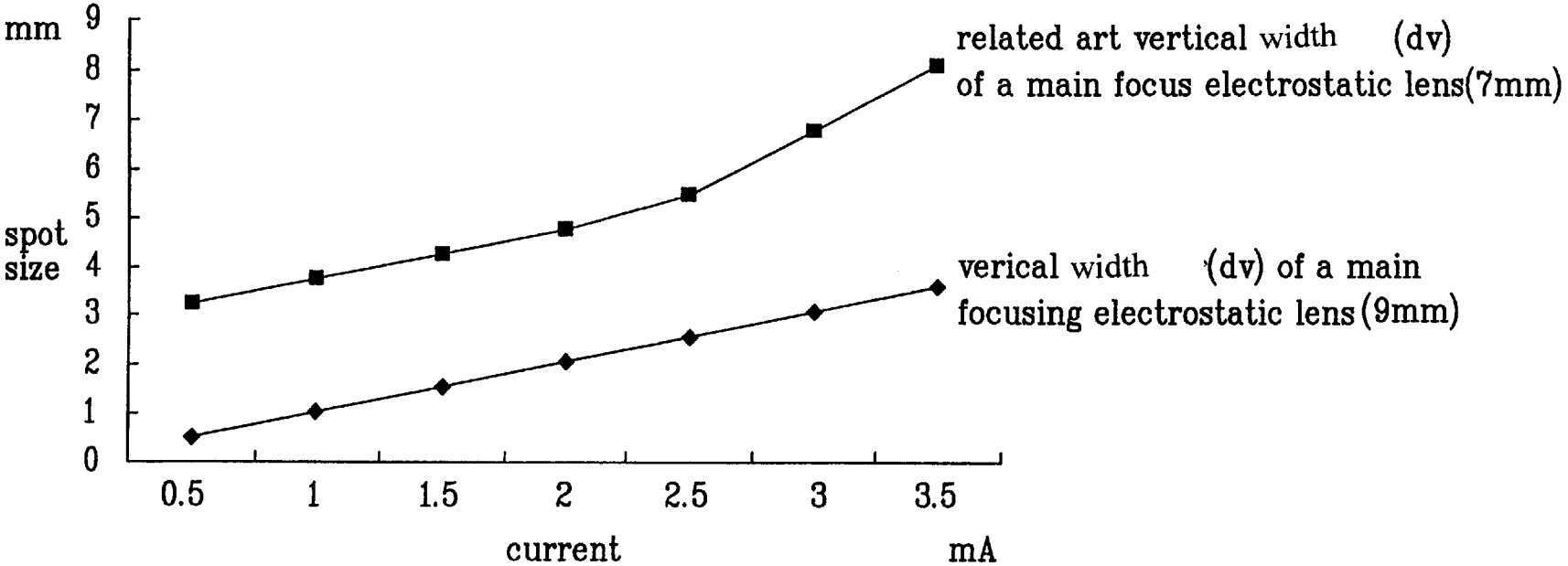

FIGS. 5A—5D illustrate different examples of electrostatic field control bodies, each fitted inside of a focus electrode and an anode;

FIG. 6 is a graph showing a depth 'D' x a vertical width 'V' x a horizontal width H of a rim of an electrostatic field control body is linearly proportional to a width of a main focus electrostatic lens according to the invention;

FIG. 7 is a graph showing a vertical width of a main focus electrostatic lens is proportional to a horizontal width 'H' of a rim, and inversely proportional to 'S', a sum of a horizontal width 'h' and a bridge width 't' of a central electron beam pass-through hole according to the invention; and FIG. 8 is a graph comparing a vertical width of a main focus electrostatic lens formed by the focus electrode, the anode, and the electrostatic field control body of the invention, and a vertical width of the related art main focus electrostatic lens.

DETAILED DESCRIPTION OF THE PREFERRED EMBODIMENT

Reference will now be made in detail to the embodiments of the invention, examples of which are illustrated in the accompanying drawings. The electron gun in a CRT according to the invention has a structure identical to the related art electron gun, except that the electron gun according to the invention has different dimensions from the related art electron gun. Accordingly, similar reference symbols used in the description of the related art electron gun will be used in the description below of the invention.

It is known that a quality of the picture formed on the fluorescent surface 7 improves as the spot size of the electron beam 3*a*, which lands on the fluorescent surface 7, decreases. The spot size of the electron beam 3*a* is proportional to a width of the main focus electrostatic lens width. A size of the main focus electrostatic lens is proportional to a size of the pass-through holes of the focus electrode 12 and the anode 13, which form the main focus electrostatic lens.

Figure 4:
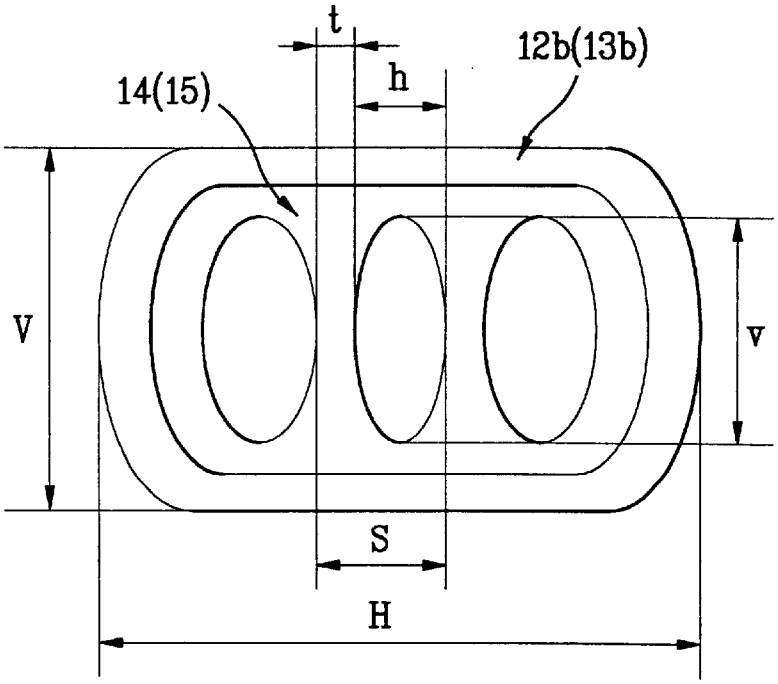

Referring to FIG. 4, the size of the electron beam pass-through hole 12*a*, 13*a* is expressed as a horizontal width 'H' and a vertical width 'V'. The vertical width 'V' is relatively small and the horizontal width 'H' is relatively large, such that the electric field permeates shallow in a vertical direction, and deep in a horizontal direction, making a curvature of a vertical equipotential surface large, and a curvature of a horizontal equipotential surface small. Thus, the horizontally elongated main focus electrostatic lens formed between the focus electrode 12 and the anode 13 focuses the electron beams 3*a*, relatively strongly in the vertical direction, and relatively weakly in the horizontal direction.

However, the electrostatic field control body 14, 15 suppresses the permeation of the electric field in the horizontal direction, enlarging the horizontal equipotential lens surface. Thus, the main focus electrostatic lens has an enhanced horizontal direction focus power, balancing the horizontal and vertical focus powers.

Figure 5A:
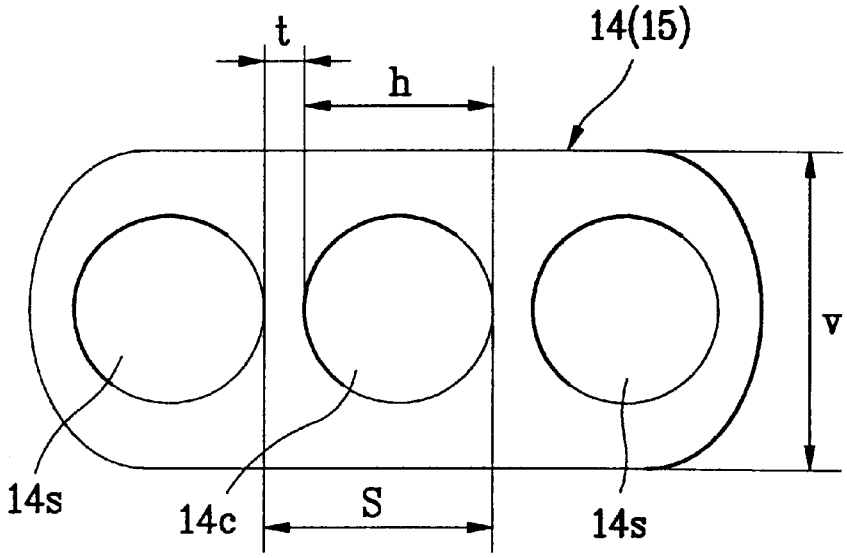

FIGS. 5A–5D illustrate different examples of electrostatic field control bodies fitted inside of a focus electrode and an anode. FIG. 5A is a front view of an XL (extended large aperture) type electrostatic field control body developed by RCA. The XL type electrostatic field control body 14, 15 is a planar body with three in-line type circular electron beam pass-through holes 14*c* and 14*s*. It is known that, in the case of the XL type electrostatic field control body 14, 15, forming identical spot sizes for the central and outer beams is difficult.

Figure 1:
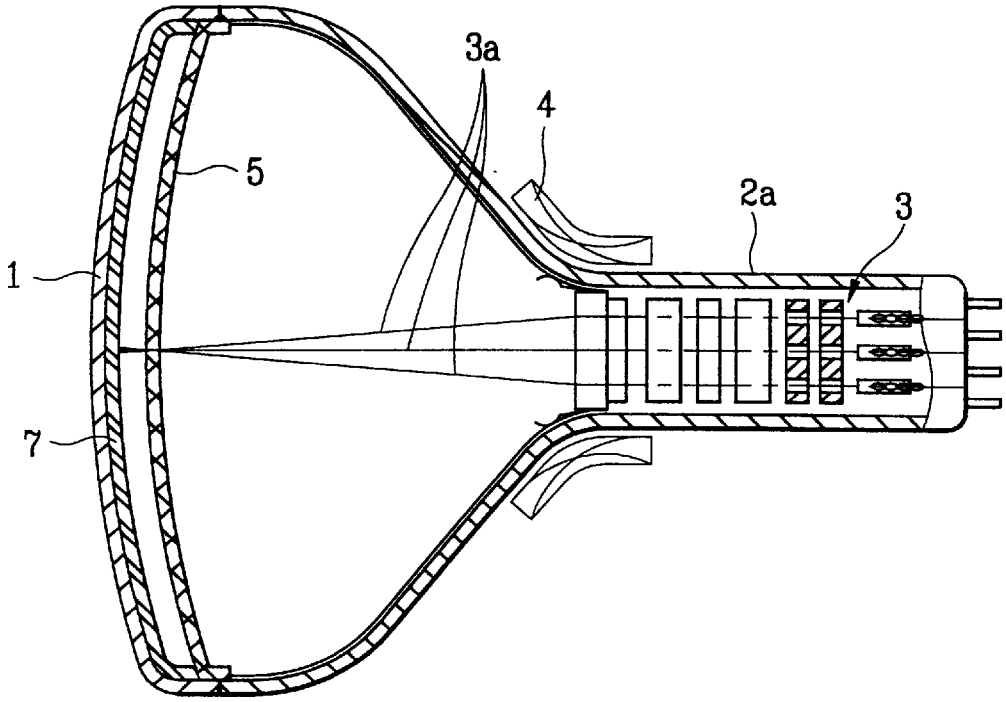
Figure 2:
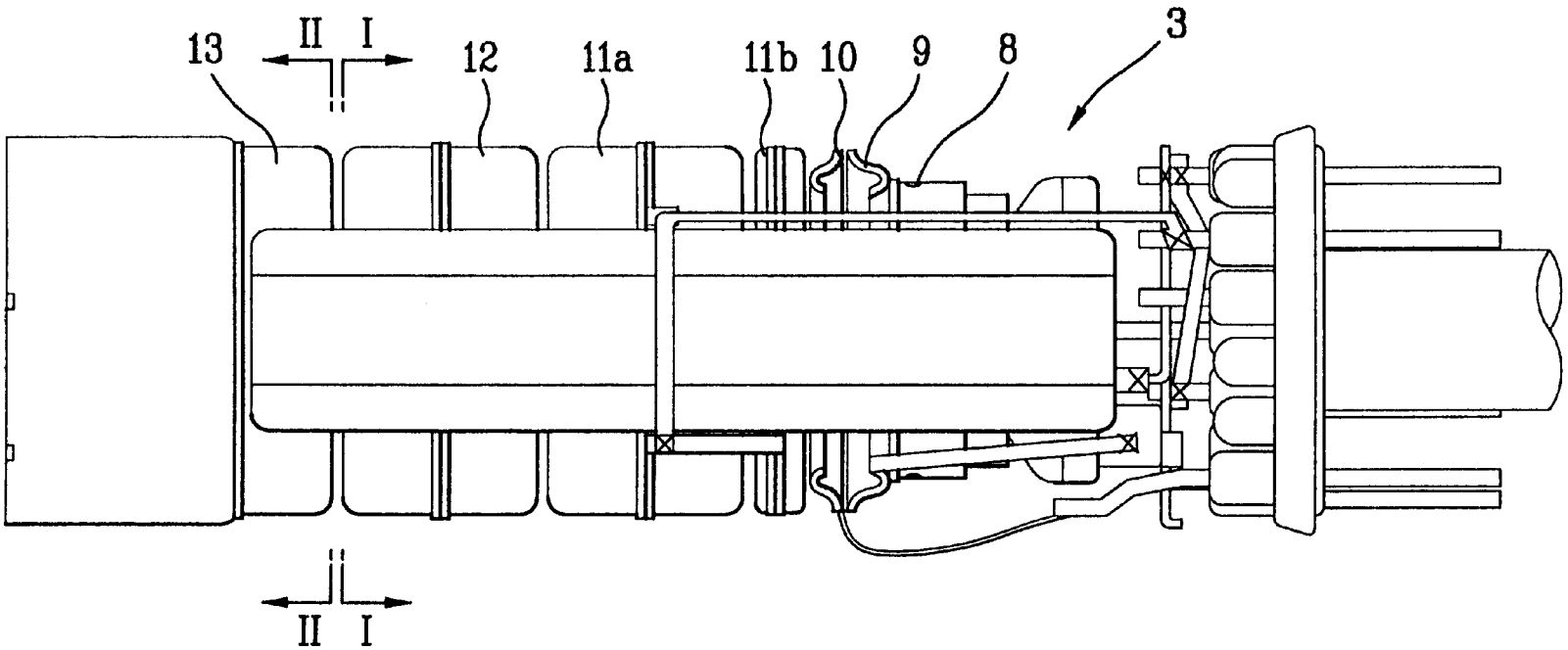
Figure 3:
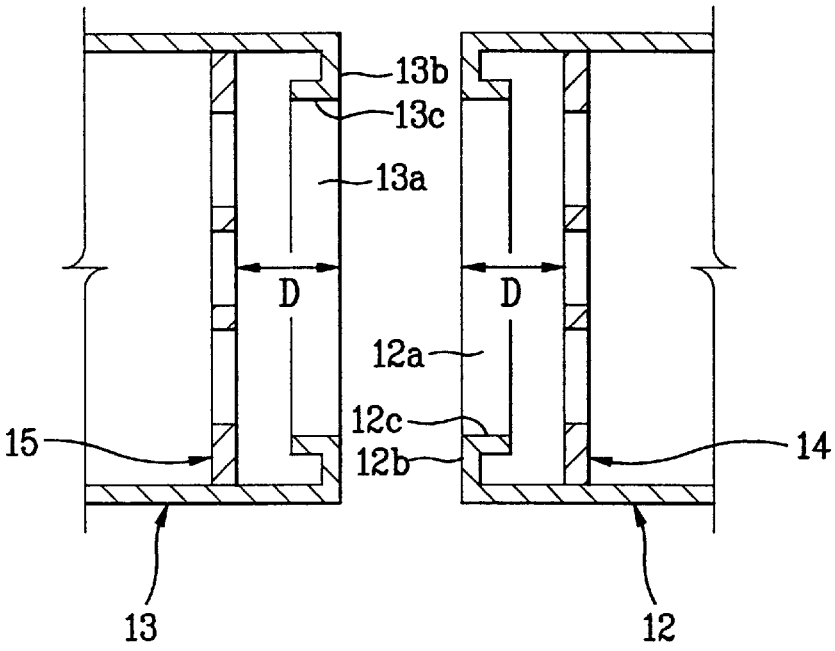
Figure 5B:
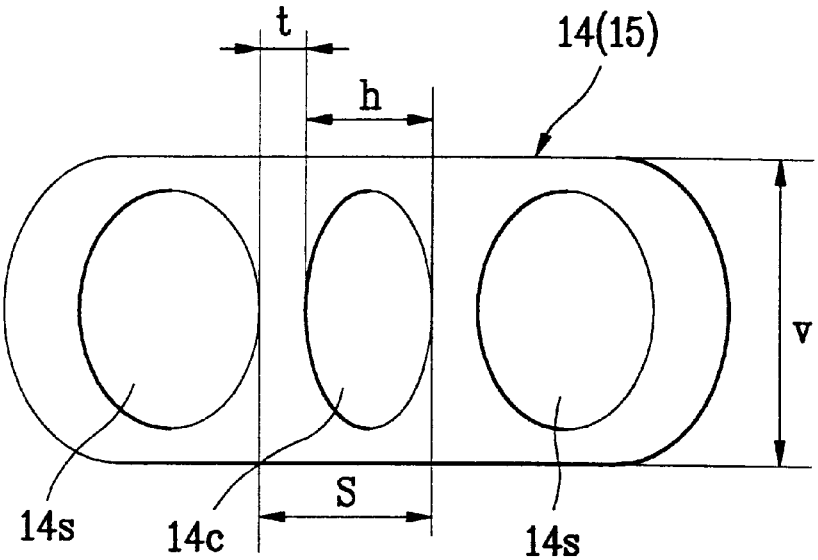

FIG. 5B is a front view of an electrostatic field control body developed by Hitachi in Japan, which is also illustrated in FIG. 3, as a side view section and which is fitted in the focus electrode 12 or anode 13 and is a view taken along line I—I or II—II of FIG. 2, respectively. This type of electrostatic field control body 14, 15 is a planar body having three in-line type vertically elongated elliptical electron beam pass-through holes 14*c* and 14*s*, with a central electron beam pass-through hole 14*c* elongated more than the outer electron beam pass-through hole 14*s*. It is known that the foregoing electrostatic field control body can correct aberration on a screen of a CRT, and satisfies the requirement of positive convergence.

Figure 5C:
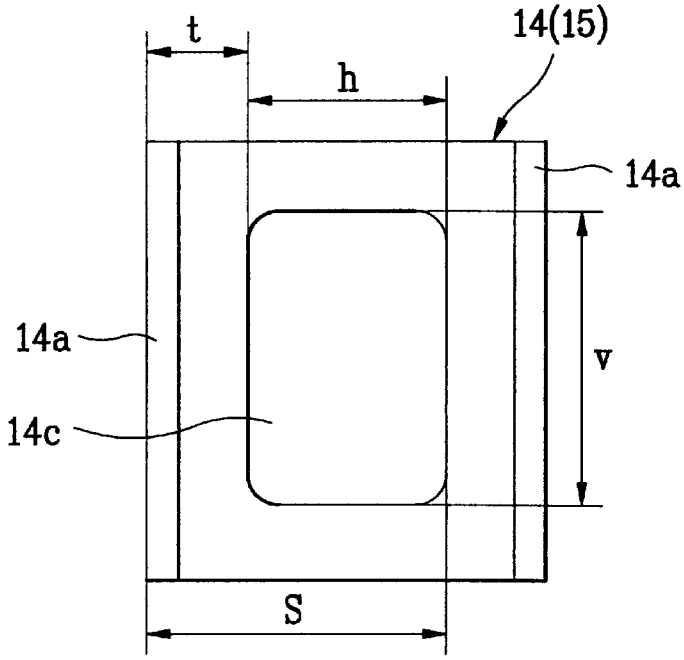

FIG. 5C illustrates a front view of a LB (Large aperture with Blade) type electrostatic field control body developed by the Applicant. The LB type electrostatic field control body 14, 15 has a central rectangular electron beam pass-through hole 14*c*, and vertical blades 14*a* on both sides thereof extending in a direction parallel to a direction of travel of the electron beams 3*a*. This example is advantageous in that the blades 14*a* increase a section modulus strengthening the electrostatic field control body 14, 15 against deformation. However, since the blades 14*a* impede horizontal permeation of the electric field, making a horizontal curvature of the main focus electrostatic lens larger, the electron beams 3*a* are focused excessively.

Figure 5D:
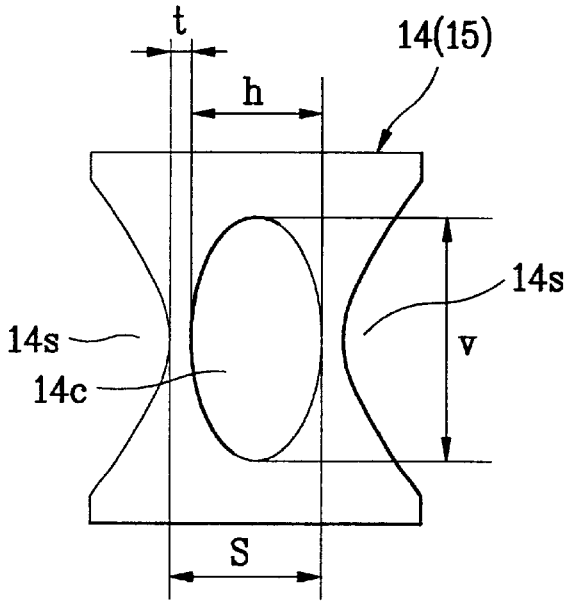

FIG. 5D illustrates a front view of an EA (Elliptical Aperture) type electrostatic field control body developed by Hitachi. The EA type electrostatic field control body 14, 15 is a planar body having a central vertically elongated elliptical electron beam pass-through hole 14*c*, and outer vertically elongated elliptical electron pass-through holes 14*s*. Since the electrostatic field control body 14, 15 has no blades 14*a* and 15*a*, as shown in FIG. 5C, the horizontal permeation of the electric field is not impeded, reducing a horizontal curvature of the main focus electrostatic lens, and a large sized main focus electrostatic lens having balanced vertical and horizontal focus powers can be formed. However, the small section modulus caused by removal of the blades 14*a* makes the EA type electrostatic field control body 14 or 15 susceptible to deformation.

Though the electrostatic field control bodies shown in FIGS. 5A–5D have different forms with respect to one another, their geometries are fixed according to the following identical dimensional expressions:

a horizontal width of a central electron beam pass-through hole: h a vertical width of a central electron beam pass-through hole: v a bridge width: t, The vertical width of a central electron beam pass-through hole v+ the bridge width t=S.

Where, in general, it is known that 'S' is equal to a beam separation, a distance between the central electron beam and the outer electron beam.

For foregoing electrostatic field control bodies, design dimensions S, h, and v, a depth of disposition, and the horizontal width 'H' and the vertical width 'V' of the rim serve as parameters for fixing a size of the main focus electrostatic lens. More particularly, a maximum size of the main focusing electrostatic lens width is fixed by parameters that can be set on the least possible side among the different design parameters of the electron gun. Accordingly, electron gun designers in the past have designed the vertical width dv and the horizontal width dh of the main focus electrostatic lens identical with reference to the least possible parameters among the parameters, in order to focus the electron beams at a central part of the screen.

As previously discussed, in the case of the electron gun in recent large-sized color CRTs where a heavy current is essential, the heavy current makes the electron beam flux thicker, and leads it to pass through a protaxis of the main focus electrostatic lens. The electron beam passing through the protaxis has more spherical aberration than one passing through a paraxis. The spherical aberration causes blooming, a phenomena in which a spot size of the electron beam is formed greater at a central part of the screen. It is known that a horizontal spot size caused by blooming can be reduced by a VM (Velocity Modulation) coil fitted to an outer circumference of the neck. However, since there has been no proper device external to the CRT for reducing a spot enlarged in a vertical direction due to spherical aberration, vertical blooming still remains on the screen, and deteriorates a vertical focus characteristic of the screen.

According to the invention parameters of the electrostatic field control bodies 14 and 15, design dimensions S and v, fitting depths 'D', a horizontal width 'H' and a vertical width 'V' of each of the electron beam pass-through holes 12*a* and 13*a* formed by rims 12*b* and 13*b*, are manipulated to fix the sizes of main focus electrostatic lens widths dh and dv. That is, Applicant has studied which parameters influence the horizontal width dh and the vertical width dv of the main focus electrostatic lens.

Applicant's study has determined that the vertical width dv of the main focus electrostatic lens is related to the vertical width V of the electron beam pass-through hole formed by the rim, the vertical width v of the central electron beam pass-through hole of the electrostatic field control body, and the depths D of the electrostatic control bodies 14,15 from the rims 12*b*, 13, respectively. As shown in FIG. 6, a product of the three parameters VxvxD is linearly proportional to the vertical width dv of the main focus electrostatic lens, which may be expressed by the following equation (2):

$$dv=(VxvxD)/29 \quad (2)$$

Moreover, as shown in FIG. 7, the horizontal width dh of the main focus electrostatic lens is proportional to the horizontal width H of the rims 12*b*, 13*b*, and inversely proportional to 'S', a sum of a horizontal width h of the central electron beam pass-through hole 14, 15 and a bridge width 't', which may be expressed by the following equation (3):

$$dh=H-2\times S \quad (3)$$

Therefore, to form a main focus electrostatic lens having a large vertical width dv, the different parameters of the electrostatic field control bodies 14, 15 may be adjusted to maintain design dimensions of the rims 12*b*, 13*b* and the electrostatic field control bodies 14, 15 in order to meet the conditions of $(VxvxD)/29 \geqq (H-2\times S)$.

FIG. 8 is a graph comparing a vertical width dv of a main focus electrostatic lens formed by the focus electrode, the anode, and the electrostatic field control body of the invention, and a vertical width of a related art main focus electrostatic lens. Referring to FIG. 8, if the electron gun is designed according to the conditions discussed above, the vertical width dv of the main focus electrostatic lens according to the invention is greater than the vertical width dv of the related art main focus lens by approximately 2 mm. Accordingly, even if the electron beams pass through a protaxis in the case where the electron gun uses a heavy current according to the recent trend to form a thicker flux of the electron beams, since the vertical width of the main focus electrostatic lens is enlarged, the electron beams are not distorted by spherical aberration, but focused on the screen exactly, thereby improving a vertical resolution of the picture.

Thus, the invention has verified all parameters that influence a size of the main focus electrostatic lens. That is, different from the related art, the invention has verified that the size of the main focus electrostatic lens is limited, not only by the least possible parameters among the different design parameters that can be set for the focus electrode, the anode, and the electrostatic field control body, but also can be adjusted by many parameters. Thus, the vertical width can be increased with respect to the related art.

The conditions set forth in the invention not only satisfy the object of enlarging the vertical width of the main focus electrostatic lens, but also, if necessary, may be utilized to enlarge the horizontal width of the main focus electrostatic lens.

The foregoing embodiments and advantages are merely exemplary and are not to be construed as limiting the invention. The present teaching can be readily applied to other types of apparatuses. The description of the invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures

What is claimed is:

1. An electron gun in a color CRT comprising:

three cathodes for emitting electron beams;

a plurality of electrodes for acceleration; and, a focus electrode and an anode each including;

an opposite rim having a single electron beam pass-through hole with a vertical width V and a horizontal width H, and an electrostatic field control body at a depth D from the rim, with a bridge width 't', and a vertical width v and a horizontal width h of a central electron beam pass through-hole, wherein the electrostatic field control body and the focus electrode and the anode have the following relation $$(VxvxD)/29 \geqq H-(2\times S),$$

where, S denotes a sum of the horizontal width h and the bridge width t of the electrostatic field control body.

2. An electron gun for a CRT, comprising:

at least one cathode for emitting electron beams;

at least one acceleration electrodes; and a focus electrode and an anode each including:

an opposite rim having an electron beam pass-through hole with a vertical width V and a horizontal width H; and an electrostatic field control body positioned at a distance D from the rim, with a bridge width 't', and a vertical width v and a horizontal width h of a central electron beam pass-through hole, wherein the electrostatic field control body and the focus electrode and the anode are configured to satisfy the following equation:

$$(VxvxD)/29 \geqq H-(2\times S),$$

where, S denotes a sum of the horizontal width h and the bridge width t of the electrostatic field control body.

3. The electron gun according to claim 2, wherein the CRT is a color CRT.

4. The electron gun according to the claim 2, wherein the at least one cathode comprises three cathodes.

5. The electron gun according to claim 2, wherein the at least one acceleration electrode comprises a plurality of acceleration electrodes.

* * * * *